US005282561A

United States Patent [19]

Mihalich

[11] Patent Number: 5,282,561

[45] Date of Patent: Feb. 1, 1994

[54] PORTABLE BEVERAGE DISPENSER

[76] Inventor: Herman Mihalich, 1134 Knox Ave., Monessen, Pa. 15062

[21] Appl. No.: 303,937

[22] Filed: Mar. 27, 1989

Related U.S. Application Data

[63] Continuation of Ser. No. 76,940, Jul. 13, 1987, abandoned.

[51] Int. Cl.[5] ..... B67D 5/62

[52] U.S. Cl. ..... 222/146.6; 62/399; 222/399

[58] Field of Search ..... 222/131, 173, 146.1, 222/146.6, 399, 130; 62/389, 393, 398, 399, 400, 449, 457, 459, 464, 390

[56] References Cited

U.S. PATENT DOCUMENTS

| | | | |
|---|---|---|---|
| 1,139,353 | 5/1915 | Ellis | 222/399 X |
| 1,772,111 | 8/1930 | Rice | 222/146.6 X |
| 1,979,219 | 10/1934 | Bodine | 62/400 X |
| 2,080,598 | 5/1937 | Bodenstab | 222/130 X |
| 2,732,977 | 1/1956 | Charpiat | 222/399 X |
| 2,774,229 | 12/1956 | Thau et al. | 222/146.6 X |
| 2,792,692 | 5/1957 | Bryan | 222/146.6 X |
| 2,917,906 | 12/1959 | Woolley | 222/146.6 X |
| 3,106,074 | 10/1963 | Amburgey, Jr. | 62/464 |
| 3,147,889 | 9/1964 | Dolgin | 222/131 |
| 3,180,529 | 4/1965 | Buffington | 222/131 |
| 3,312,083 | 4/1967 | Scoggins et al. | 62/399 X |
| 3,315,846 | 4/1967 | Landis et al. | 222/399 X |
| 3,327,902 | 6/1967 | Alterwitz | 222/146.1 X |
| 3,331,536 | 7/1967 | De Lorenzo | 222/146.1 X |
| 3,354,668 | 11/1967 | Cserny | 62/389 |
| 3,712,514 | 1/1973 | LeBlanc | 222/399 X |
| 4,225,059 | 9/1980 | Kappos | 222/146.6 |
| 4,272,968 | 6/1981 | Harvill | 62/390 X |
| 4,617,807 | 10/1986 | Pritchett et al. | 62/399 |
| 4,651,538 | 3/1987 | Bull et al. | 222/146.6 X |

FOREIGN PATENT DOCUMENTS

| | | | |
|---|---|---|---|
| 74623 | 4/1894 | Fed. Rep. of Germany | 62/398 |

*Primary Examiner*—Kevin P. Shaver
*Attorney, Agent, or Firm*—Hymen Diamond

[57] ABSTRACT

A beer dispenser for use without electric power facilities. The dispenser includes a thermally insulated cabinet for receiving a beer barrel. The cabinet has an opening in the front provided with an insulated door through which the barrel is inserted. An ice chest is mounted above the cabinet. The partition between the ice chest and the cabinet serves in common as the base of the ice chest and a ceiling for the cabinet and is thermally conducting so that there is heat interchange between the interior of the cabinet and the ice chest. The ice chest contains a cold plate. The coil is connected to the barrel at the input and to a spigot at the level of the ice chest at the output. The dispenser is provided with a hand pump or with a $CO_2$ tank for applying pressure to the beer in the barrel. The ice in the ice chest cools both the beer flowing through the coil and the beer in the barrel so that the formation of "picnic beer" is avoided.

10 Claims, 3 Drawing Sheets

PORTABLE BEVERAGE DISPENSER

REFERENCE TO RELATED APPLICATION

This application is a continuation of application Ser. No. 07/76,940 filed Jul. 13, 1987 to Herman Mihalich, now abandoned.

BACKGROUND OF THE INVENTION

This invention relates to beverage dispensers and it has particular relationship to readily portable beverage dispensers. The invention will be described herein as applied to a beer dispenser to which it is uniquely applicable. It is understood that to the extent that this invention is applicable to the dispensing of other beverages than beer, such application and use is within the scope of equivalents of this invention.

A portable beer dispenser includes a compartment for receiving a barrel of beer, a facility for cooling the beer, a beer-drawing mechanism and a gas tank, or the like, for applying pressure to drive the beer through the beer-drawing mechanism. The facility for cooling the beer is an ice chest in which there is a cold plate through which the beer is conducted. Ice is deposited in the ice chest to provide the cooling. Cserny, U.S. Pat. No. 3,354,668, typifies the prior art of portable beverage dispensers. Cserny suffers from the disadvantage that it includes a refrigerator which requires electrical power for operation. The demand for electric power is a serious impediment to portability and to the uses to which a beverage dispenser can be put.

Rice, U.S. Pat. No. 1,772,111, also typifies the prior art of portable beverage dispensers. Rice discloses a dispenser which does not require electric power facilities, but it has other disadvantages. In Rice, the beverage container is disposed in an open compartment. The beverage is supplied from the container to a spout through cooling coils which are contained in a cooling chamber insulated from the compartment in which the beverage container is disposed. Beer dispensers as disclosed in Rice would produce what is called "picnic beer". A glass or mug of "picnic beer" is mostly foam. Another disadvantage of a dispenser such as is shown in Rice, is that it does not lend itself to use in the home over a period of several weeks. Since only the cooling coils are cooled, the beer in the barrel would remain warm when not in use and would disintegrate and sour.

It is an object of this invention to provide a portable beverage dispenser, particularly a beer dispenser, which shall not require electric power facilities and in whose use a palatable cold beverage, free of the properties of "picnic beer", shall be delivered.

SUMMARY OF THE INVENTION

This invention arises from the realization that the "picnic beer" in a dispenser such as is disclosed by Rice, results from the fact that the beer beverage in a dispenser like Rice's is warm. As the warm beer passes through the cold plate, it is suddenly cooled. The rapid drop in temperature is accompanied by a drop in pressure which produces excessive foam.

In accordance with this invention, there is provided a beer dispenser in which the ice chest performs two functions; it cools the beer which flows through the cold plate and also cools the beer in the barrel. The beer is cold when it flows into and through the cold plate and "picnic beer" does not flow out of the beer-drawing mechanism because the sharp drop in temperature and pressure of the beer does not occur.

The beer dispenser, in accordance with this invention, is an integrated unit including a lower compartment for receiving a beer barrel and an upper compartment including the ice chest. The base of the ice chest also serves as at least a part of the roof or ceiling of the lower compartment. The beer barrel is connected to the cold plate in the ice chest. The common base and ceiling is composed of thermally conducting material so that there is thermal interchange between the ice chest, i.e., the ice in the ice chest, and the lower compartment and the beer in the barrel is cooled before it passes through the cold plate. Typically, the container of the ice chest may have the shape of a flanged pot and may be composed of aluminum. The pressure for driving the beer through the cold plate may be derived from a band pump mounted on the dispenser unit or from a $CO_2$ tank disposed in an upper compartment adjacent to the ice chest. The beer-drawing mechanism may be a spigot suspended from the external wall of the ice chest. This has the advantage that the conductor between the outlet of the cold plate and the spigot passes through the ice in the ice chest directly to the spigot and the outflowing beer is maintained cool.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

DETAILED DESCRIPTION OF EMBODIMENT

Figure 1:
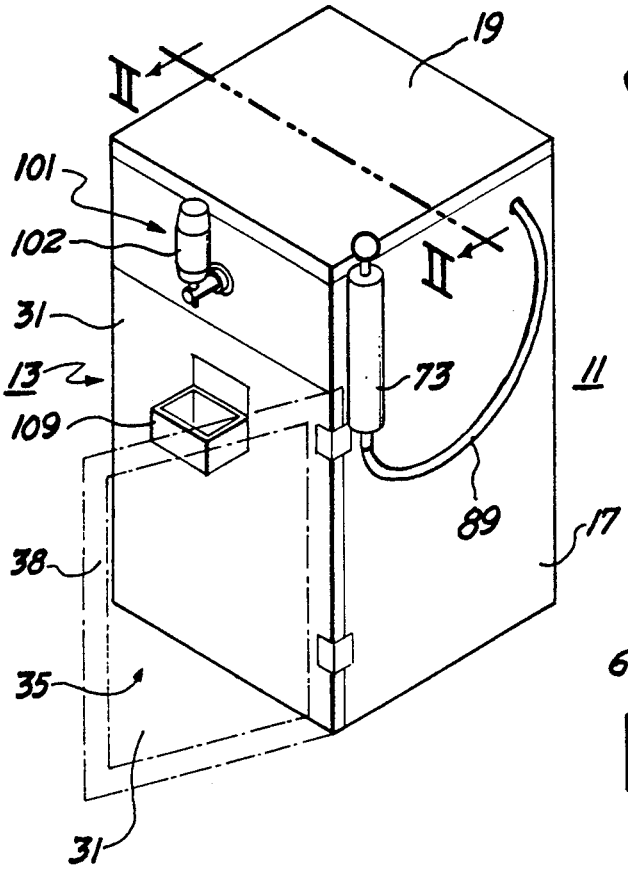
FIG. 1 is a view in isometric of a beverage or beer dispenser which embodies this invention.
Figure 4:
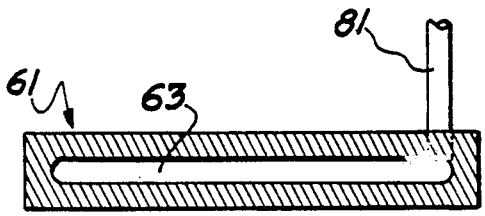
FIG. 4 is a fragmental view in longitudinal section taken in the direction IV—IV of FIG. 3.
Figure 5:
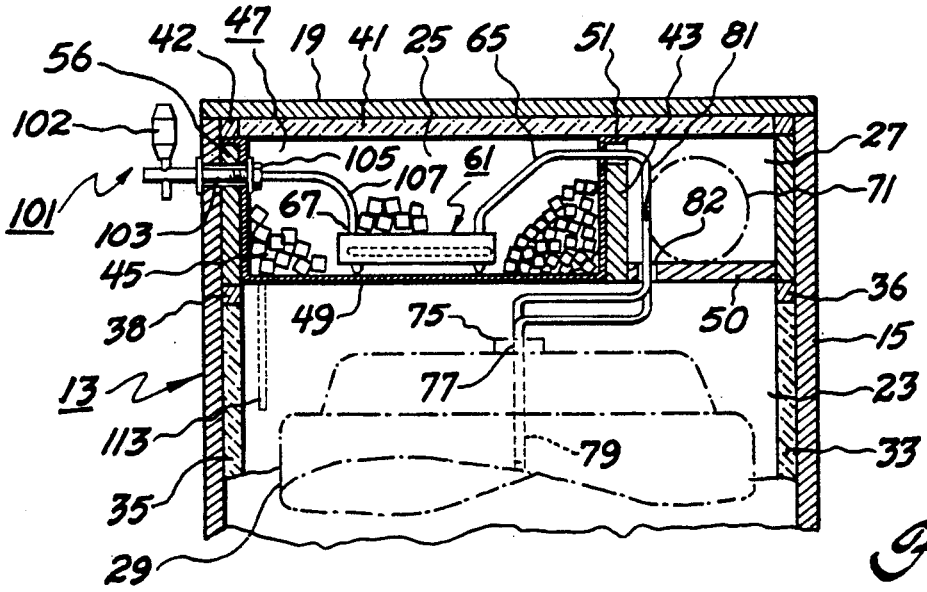
FIG. 5 is a view in longitudinal section taken in the direction V—V of FIG. 2.
Figure 6:
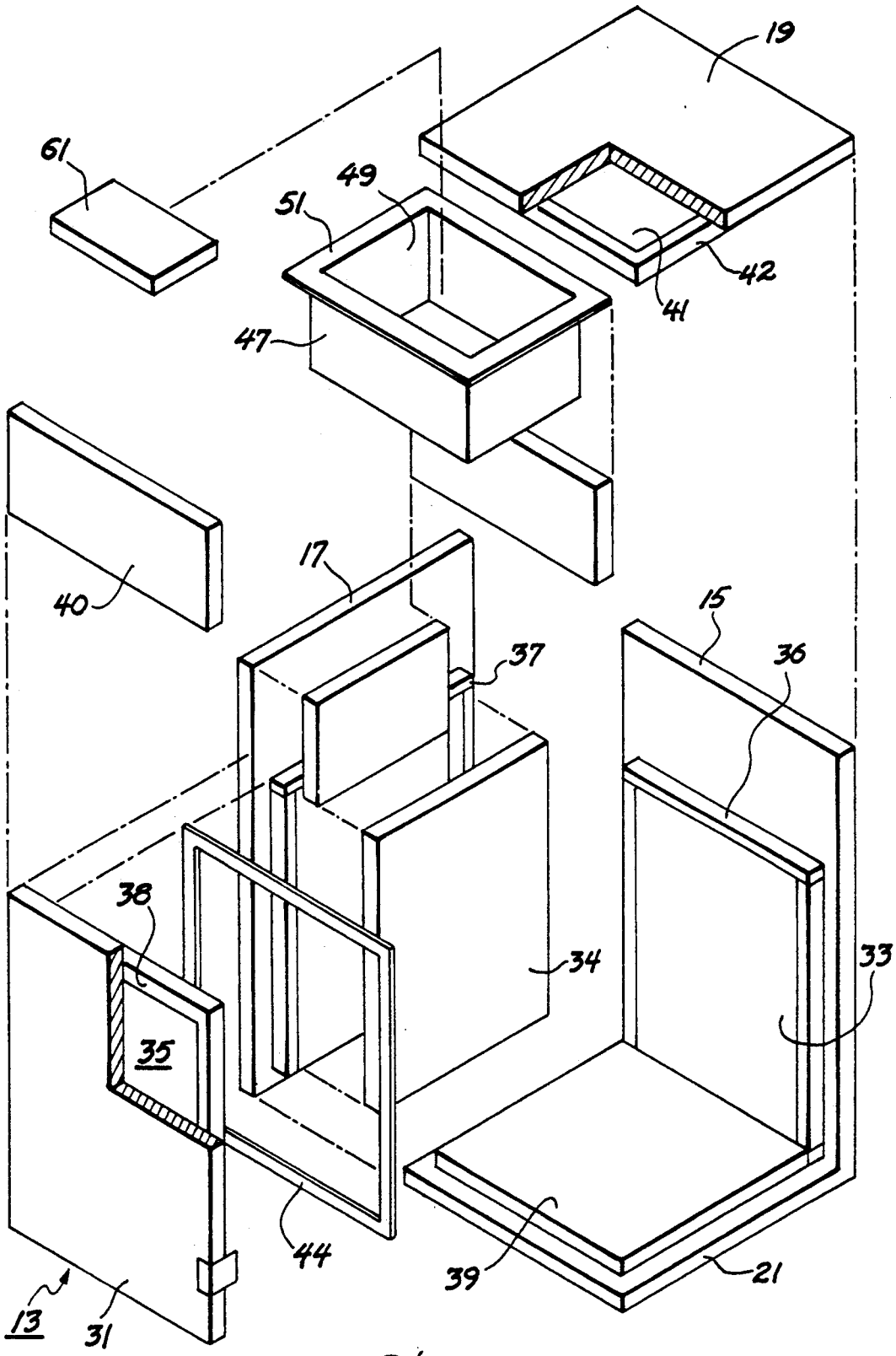
FIG. 6 is a view in isometric showing the principal parts of the beverage dispenser in accordance with this invention which would be supplied in a kit for assembly by the user.

The drawings show a beverage dispenser 11 in accordance with this invention. The dispenser 11 is an integrated unit in the form of a rectangular parallelapiped whose external front wall 13, rear wall 15 (FIG. 3), side walls 17, top 19 and bottom 21 (FIG. 2) are composed of a material such as plywood. Typically, in its outside dimensions, the dispenser is 37½ inches high by 21 inches square. Within the unit there is a lower compartment or cabinet 23 (FIGS. 4, 5) and a plurality of upper compartments 25 and 27. The lower compartment 23 is dimensioned to receive a beer barrel 29 of a size suitable for use in the home or outdoors at a picnic or cook-out, typically a half keg of beer. The lower compartment 23 is provided with a door 31 through which the barrel 29 may be placed in the cabinet. The parts of the rear wall 15 and the side walls 17 which bound the cabinet 23 are lined with thermal insulation 33 (FIGS. 3, 5, 6) and 34, typically styrofoam. The door 31 is also lined with insulation 35 internally. The insulation 33 is held in a frame 36 (FIGS. 5, 6). The insulation 34 of each side wall is held in a three-sided frame 37. The insulation on the door is held in a frame 38. A strip 40 extends between the tops of the frame 37 at the entrance to the opening. The bottom 21 of the dispenser 11 is reinforced by a board 39, typically of plywood. The door frame which is formed by the outer surface ends of the walls 17, of the bottom 21 and of the strip 40, are provided with strips 44 of rubber which serve as a gasket. The top 19 is lined with insulation 41 bounded by a frame 42.

The compartments 25 and 27 (FIG. 5) are separated by a partition 43, typically of plywood. The compartment 25 constitutes the ice chest and is in use filled with ice cubes 45 or contains a block of ice. The top of compartment 25 is the insulation 41; the sides and bottom are formed by a pan 47 of a thermally conducting material such as aluminum. The lower end of the outer side of the pan 47 abuts the strip 40 (FIG. 6). The base 49 of the pan 47, in addition to serving as the lower boundary of compartment 25, also serves as a part of the ceiling or roof of the lower compartment 23. The ice 45 cools the base 49 by conduction which in turn cools the barrel 29 by convection and radiation; the barrel cools the beer by conduction. There is effective thermal interchange between the beer and the ice 45. The pan 47 has a flange 51. The pan 47 is mounted in the dispenser with its flange 51 engaged on the three outer sides between the strips 42 and the insulation 41 which lines the top 19, the upper ends of the reinforcing boards 53 and 55 and 56 which line the upper parts of the side walls 17 and the front wall 13. On the fourth side, the flange 51 is engaged between the insulation 41 and the partition 43. The walls 53, 55, 56 and the partition 43 may be seen as an open-ended box.

Figure 3:
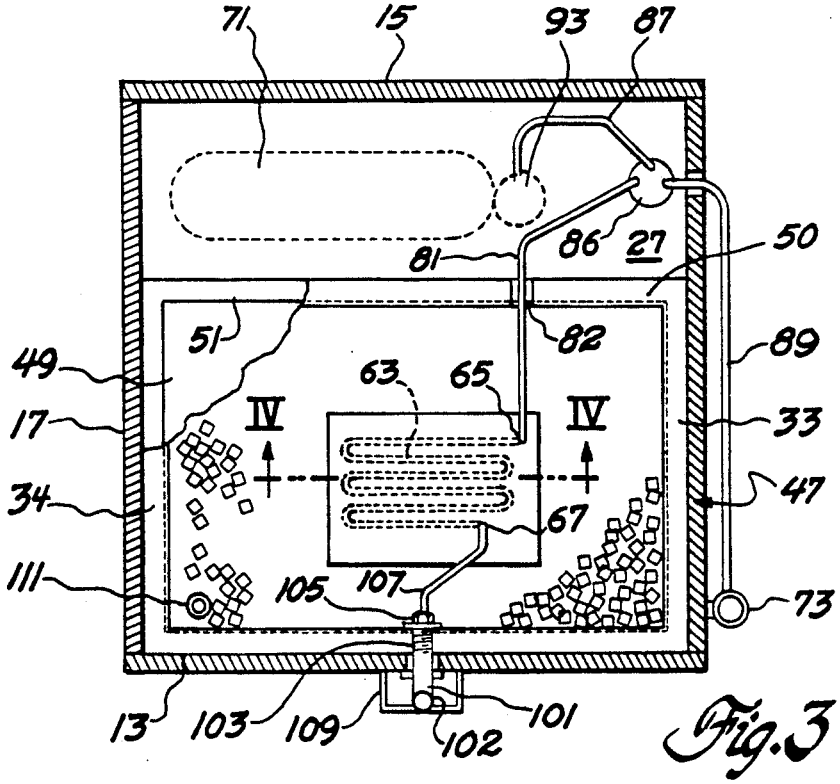
FIG. 3 is a view in transverse section taken along line III—III of FIG. 2.

A cold plate 61 is disposed in the compartment 25. The cold plate 61 is a block composed typically of aluminum within which there is a sinusoidal passage 63 (FIGS. 3, 4) through which the beer is conducted and cooled. The cold plate 61 has an inlet 65 and outlet 67 (FIGS. 3, 5). It is desirable that the cold plate 61 have the same metallic composition as the pan 47 to preclude corrosion from a battery effect.

The compartment 27 may contain a $CO_2$ tank 71 for supplying gas to produce the flow of beer as demanded. A hand pump 73 is mounted on one of the sidewalls 17 as an alternative for the same purpose.

Figure 2:
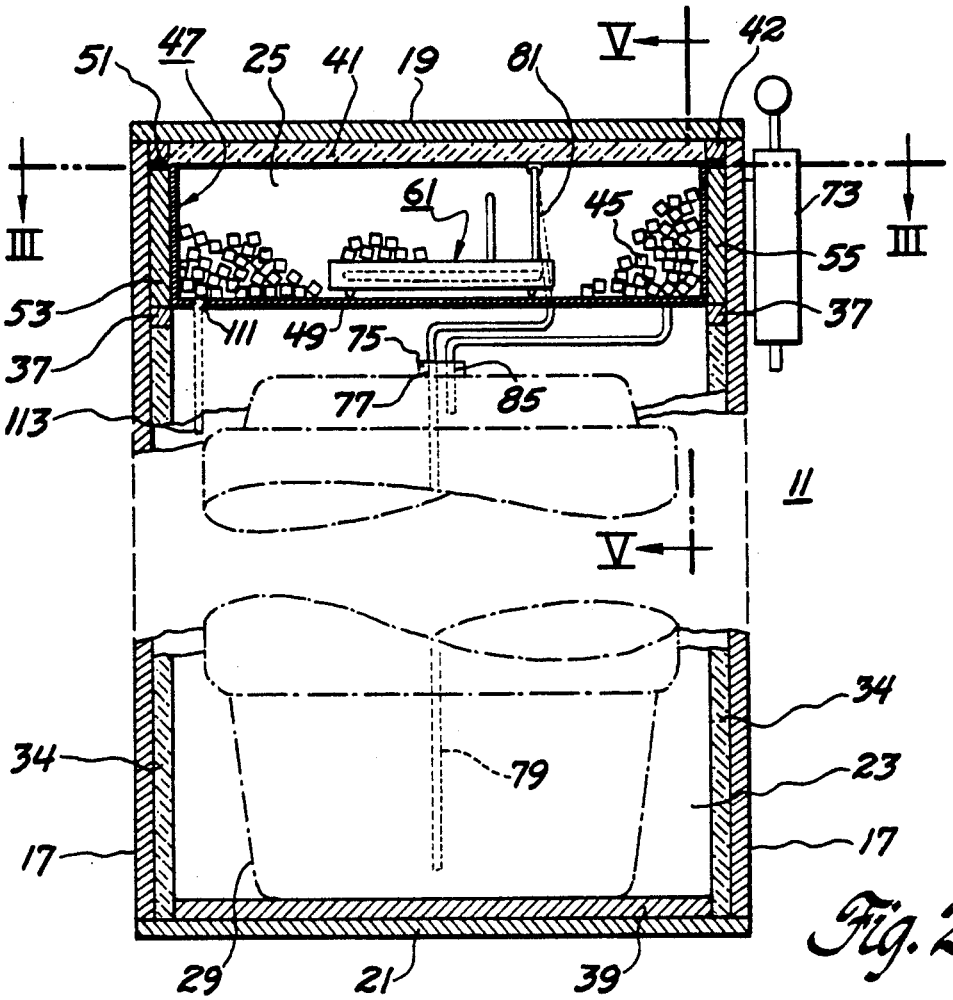
FIG. 2 is a view in longitudinal section taken in the direction II—II of FIG. 1.

The beer barrel 29 has a tap 75 (FIGS. 2 and 5). The tap 75 includes a bore 77 for drawing beer. The bore 77 is connected to a long tube 79 which extends substantially to the bottom of the barrel. A conductor or tube 81 (FIGS. 2, 3, 5) is provided for connecting the tube 79 to the inlet 65 of the cold plate 61. The conductor 81 passes through a hole 82 in the base 50 of the compartment 27 between the inlet 65 and the bore 77. The tap 75 also has a bore 85 which opens over the surface of the beer. Conductors 87 and 89 are provided for connecting the valve 93 of the tank 71 or from the pump 73 to the bore 85. Tubes 87 and 89 are passed through the hole 86. Pressure is provided either through conductor 87 or conductor 89 to drive the beer through conductor 81.

A spigot assembly 101 including a spigot 102 is mounted centrally on the front wall above the door 31. The spigot assembly 101 includes an externally threaded hollow member 103 (FIG. 5) which penetrates through holes in the wall 13, the board 56 and the pan 47. The spigot assembly is secured by a nut 105 which also secures the pan to the board 56. The hollow member 103 is connected to the outlet 67 of the cold plate 61 by conductor 107. The conductor 107 passes directly to the spigot 102 through the ice 45 which maintains the beer cold. A drain pad 109 is mounted on the door 31 vertically below the spigot 102.

The pan 47 is provided with a drain hole 111 in a corner. The drain hole 111 is connected to a tube of conductor 113. The water from the melting ice 45 is drained through the hole 111 and tube 113.

FIG. 6 shows the components of this invention as they would be distributed in a kit for assembly by the user. It is desirable that these components be constructed so that their total weight is 74 pounds or less and the components shown in FIG. 6 have been so constructed in a dispenser made by applicant. Under US Postal regulations, the maximum weight that can be shipped is 74 pounds exclusive of packing.

This invention provides a portable beer dispenser in whose use "picnic beer" is avoided. When this dispenser is used in the home, it serves to maintain the beer cold and prevent its becoming sour even if the beer in a barrel is used over a period of weeks. All that is necessary is that typically ten pounds of ice be added to the ice chest periodically.

While a preferred embodiment of this invention has been disclosed herein, many modifications thereof are feasible. This invention is not to be restricted, except insofar as is necessitated by the spirit of the prior art.

I claim:

1. A portable beverage dispenser capable of use as an integrated unit both in the home and for outdoor events without electrical power facilitates and not integrated with power-driven vehicular transportation means; said dispenser including a thermally insulated cabinet for receiving a container including the beverage, an opening in said cabinet providing access to the interior of said cabinet, a thermally insulated door connected to said cabinet for closing said opening, cooling means mounted integrally with said cabinet, for cooling both the beverage in the container and the beverage flowing out of the container, said cooling means including an ice chest for containing ice, said ice chest having a wall which is structured as part of said dispenser as a partition, directly interposed between the interior of said ice chest and the interior of said cabinet as at least a part of a wall of said cabinet, said partition being composed of thermally conducting material in thermal interchange with the interior of said cabinet so that there is heat interchange between the interior of said cabinet, including the interior of said container, and the interior of said ice chest, a cooling-coil means having an input and an output in said ice chest, a beverage conductor, extending through the cooled interior of said cabinet, for connecting said beverage container to said input, so as to transmit beverage through said cooling-coil means, said thermal interchange between the interior of said cabinet and the interior of said ice chest being effective to cool the beverage in said container to preclude reaction between warm beverage and the cold cooling-coil means which would produce predominantly foam when the beverage is drawn, means, connected to said output for drawing beverage from said container, and means, connected to said dispenser and to be connected to said container, for supplying gas pressure to the beverage within the container to cause the beverage to flow from said container through said cooling-coil means.

2. The portable beverage dispenser of claim 1 wherein the ice chest has a wall opposite the thermally conducting partition, at least said opposite wall being thermally insulated.

3. The beverage dispenser of claim 1 wherein the ice chest is adapted to be filled with ice so that the partition is cooled by contact with ice.

4. The beverage dispenser of claim 1 wherein the gas-pressure supplying means includes a hand pump mounted on the external wall of the cabinet and a conductor to be connected in gas-supply relationship to the beverage container.

5. A portable beverage dispenser having a first compartment and a plurality of additional physically separate compartments contiguous to said first compartment, said first compartment constituting an insulated cabinet adapted to receive a beverage container, one of said additional compartments including an ice chest, and another of said additional compartments including means, adapted to cooperate with said beverage container, in the dispensing of beverage from said container, said ice chest having a thermally conducting base and said other compartment having means, cooperative with said conducting base, together with said conducting base constituting in effect a ceiling of said first compartment physically separating said first compartment from said other compartments thereby concentrating the cooling of said ice chest through said conducting base in said first compartment, whereby there is adapted to be effective thermal interchange between said ice chest and the beverage in said container, said ice chest being adapted to receive ice, said beverage dispenser also including means, adapted to be connected to said container, for serving said beverage, said serving means including means for passing the beverage to be served through said ice chest in thermal interchange with ice in said ice chest, said ice in said ice chest being adapted both to cool the beverage passing through said ice chest and by thermal interchange through said base of said ice chest being adapted to cool the beverage in said container before it passes through said ice chest, thereby precluding the serving of a predominantly foamy beverage.

6. A portable beverage dispenser including a thermally insulated cabinet for receiving a container containing the beverage, an opening in said cabinet providing access to the interior of said cabinet, an insulated door connected to said cabinet for closing said opening for effective insulating of the interior of said cabinet, cooling means mounted integrally with said cabinet, said cooling means including an ice chest adapted to contain ice, said ice chest having a thermally conducting wall which is structured as part of said dispenser as a partition directly interposed between the interior of said cabinet and the interior of said ice chest, said partition being adapted to be cooled by said ice, and to maintain thermal interchange relationship between the ice in said ice chest and the interior of said cabinet including the beverage in said container, and means, connected to said cooling means, adapted to be connected to said container for dispensing said beverage, said dispensing means being adapted to conduct said beverage to be dispersed through said cooling means in cooling relationship with said ice, said thermal interchange relationship between said beverage in said container and said ice in cooperation with the insulation of said cabinet being effective to cool the beverage while in said container to a low enough temperature to preclude the formation predominantly of foam of the beverage by reason of excessive temperature of said beverage as said beverage is conducted through said cooling means.

7. A portable beverage dispenser capable of use as an integrated unit both in the home and for outdoor events without electrical power facilitates and not integrates with power-driven vehicular transportation means; said dispenser including a thermally insulated cabinet for receiving a container containing the beverage, an opening in said cabinet providing access to the interior of said cabinet, a thermally insulated door connected to said cabinet for closing said opening, an ice chest mounted above said cabinet integrally therewith and having a partition, said partition being directly interposed as a wall common to said ice chest and said cabinet, said partition being composed of aluminum so that there is heat interchange between the interior of said cabinet, including the interior of said container, and the interior of said ice chest, cooling-coil means having an input and an output disposed in said ice chest, a beverage conductor extending within said cooled cabinet for connecting said beverage container to said input, so as to transmit beverage through said cooling-coil means, said thermal interchange between the interior of said cabinet and the interior of said ice chest being effective to cool the beverage in said container to preclude reaction between warm beverage and the cold cooling-coil means which would produce predominantly foam when the beverage is drawn, means, connected to said output, for draining beverage from said container, and a compartment mounted above said cabinet adjacent said ice chest for containing a gas-supply tank, and a conductor to be connected to said tank and to said container for transmitting gas to said container to drive said beverage from said container through said cooling-coil means.

8. The portable beverage dispenser of claim 7 wherein at least the wall of the ice chest opposite the partition composed of aluminum is insulated.

9. A portable beverage dispenser capable of use both in the home and for outdoor events without electrical power facilitates and not integrated with power-driven vehicular transportation means, said dispenser including a thermally sealable compartment for receiving a container of a beverage, an ice-chest compartment mounted on said beverage-container-receiving compartment integrally therewith, said ice-chest compartment including a thermally conducting partition forming in common a base for said ice-chest compartment and at least a part of a roof for said container-receiving compartment whereby there is effective thermal interchange between the interior of said ice-chest compartment and beverage within a container in said compartment, a cold plate, disposed in said ice-chest compartment, said cold plate having an input and an output, beverage drawing means connected to said dispenser, means, extending within said containing-receiving compartment, for connecting said input in beverage-receiving relationship with said beverage container, means for connecting said output in beverage transmitting relationship with said beverage-drawing means to transmit beverage through said cold plate to said beverage-drawing means, said thermal interchange between the interior of said ice chest and said beverage effectively precluding reaction between warm beverage and the cold plate which would produce predominantly foam when a beverage is drawn, means, operable without the aid of electric power for producing gas pressure, and means for connecting said gas-pressure producing means to said beverage container.

10. The portable beverage dispenser of claim 9 wherein at least the wall of the ice chest opposite the thermally conducting partition is insulated.

* * * * *